US010233651B2

(12) United States Patent
O'Leary

(10) Patent No.: US 10,233,651 B2
(45) Date of Patent: Mar. 19, 2019

(54) BUILDING SYSTEM

(71) Applicant: James Hardie Technology Limited, Dublin (IE)

(72) Inventor: Kevin O'Leary, Fontana, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 15/775,352

(22) PCT Filed: Dec. 20, 2016

(86) PCT No.: PCT/US2016/067823
§ 371 (c)(1),
(2) Date: May 10, 2018

(87) PCT Pub. No.: WO2017/112691
PCT Pub. Date: Jun. 29, 2017

(65) Prior Publication Data

US 2018/0340337 A1 Nov. 29, 2018

Related U.S. Application Data

(60) Provisional application No. 62/387,408, filed on Dec. 23, 2015.

(51) Int. Cl.
*E04F 13/08* (2006.01)
*E04D 5/14* (2006.01)
*E04F 15/02* (2006.01)

(52) U.S. Cl.
CPC ..... *E04F 13/0803* (2013.01); *E04D 5/145* (2013.01); *E04F 2015/0205* (2013.01)

(58) Field of Classification Search
CPC ..... E04F 2015/02094; E04F 13/0826; E04F 2015/0205; E04F 13/0803; E04D 5/145
See application file for complete search history.

(56) References Cited

U.S. PATENT DOCUMENTS 3,968,608 A * 7/1976 Swango ..... E04B 2/96 52/235
5,641,584 A 6/1997 Andersen
7,028,440 B2 4/2006 Brisson
(Continued)

FOREIGN PATENT DOCUMENTS

WO WO 2017/112691 A1 6/2017

OTHER PUBLICATIONS

International Search Report and Written Opinion for corresponding PCT Application No. PCT/US2016/067823 filed Dec. 20, 2016, dated Mar. 24, 2017, 24 pages.

*Primary Examiner* — Andrew J Triggs
(74) *Attorney, Agent, or Firm* — Knobbe Martens Olson & Bear, LLP

(57) ABSTRACT

A furring strip for mounting a cladding article to a building substrate, the furring strip comprising a first member, a second member parallel to the first member, and a web disposed between and spacedly coupling the first member and the second member. The first member, the second member, and the web form at least one u-shaped channel configured to receive and retain a wall cladding panel. The furring strip is fixable to a building substrate by mechanical or chemical fasteners to retain one or more cladding articles at a fixed spacing from the building substrate.

20 Claims, 12 Drawing Sheets

(56) References Cited

U.S. PATENT DOCUMENTS

| | | | | |
|---|---|---|---|---|
| 7,743,575 | B2 * | 6/2010 | Ito | E04F 13/0889 52/461 |
| 8,117,801 | B2 | 2/2012 | Jambois | |
| 8,393,123 | B2 | 3/2013 | Schiffmann | |
| 8,429,866 | B2 | 4/2013 | Knight | |
| 8,555,581 | B2 | 10/2013 | Amend | |
| 8,689,509 | B2 | 4/2014 | Gleeson | |
| 8,826,620 | B2 | 9/2014 | Krause | |
| 9,021,767 | B1 * | 5/2015 | Barrett, Jr. | E04F 13/0826 248/300 |
| D746,669 | S * | 1/2016 | McBride | E04B 1/40 D25/121 |
| 2006/0216109 | A1 * | 9/2006 | Sharkozy | E04F 13/0805 403/387 |
| 2010/0263316 | A1 * | 10/2010 | Bruneau | E04F 13/0803 52/546 |
| 2012/0005967 | A1 * | 1/2012 | Hourihan | A47K 3/008 52/35 |
| 2014/0260043 | A1 * | 9/2014 | Cottier | E04F 13/0826 52/489.2 |
| 2014/0311064 | A1 | 10/2014 | Beaty | |
| 2015/0047281 | A1 | 2/2015 | Cole | |
| 2015/0135626 | A1 | 5/2015 | Colyn | |

* cited by examiner 100
6
2
11
7
9
8
9
10
8
4

100
66
6
2
62
64
8
8
10
42
4
44
46

100

10
6
4
2
4
2
6
10
100

4
100
6
10
1D
1D
10

600
10c
10d
30a
30
32
34
34b
30b 30a
30
10c
32
10d
34
34b
10e
30b
600

30a
30
34
34b
10c
10d
6C
6C
600

BUILDING SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure generally relates to fiber cement building systems.

Description of the Related Art

Fiber cement articles are conventionally used as cladding materials to form the exterior of a building by attaching the fiber cement article over a building substrate. Fiber cement articles are typically attached to the exterior of a building with a wood furring strip disposed between the cladding article and the building substrate to form an air gap or air space between the fiber cement article and the building substrate, thus forming a rain screen system. The air gap between the fiber cement article and the house wrap creates a capillary break which allows for drainage and evaporation. The furring strips function to set the fiber cement article apart from the building frame thereby establishing the air gap necessary to form the rain screen system.

Attaching fiber cement articles to wood furring strips in a rain screen system can present a number of disadvantages. Some fiber cement articles are considered to be relatively heavy as compared with other cladding materials, such as, for example, wood cladding materials. In such instances, larger wood furring strips are used with the fiber cement articles to provide similar wind load capacity relative to the furring strips used for wood cladding materials. Some fiber cement articles also include a foam insulation layer which increases the thickness of the article and makes direct nailing of the article to a wood batten more difficult. Thus, there is a need to provide a system for creating an air gap that can support fiber cement articles while providing acceptable wind load capacity.

SUMMARY

Accordingly, the present disclosure provides in one embodiment a fiber cement cladding article and furring strip which together form a system which provide built in alignment and rainscreen protection between interior and exterior walls of a building.

The furring strip of certain embodiments of the present disclosure is used to attach the fiber cement cladding article to a building substrate. Conveniently, the furring strip of the present disclosure is configured such that a number of methods of attaching the fiber cement cladding article to a building substrate are accommodated.

In one embodiment a building system is described. The building system comprises a furring strip attached to a building substrate and at least one wall cladding panel. The furring strip comprises a first member adjacent and parallel to the building substrate, a second member parallel to the first member, and a web disposed between the first member and the second member to form a channel defined by a channel width, the first member and the second member being spaced apart by the channel width. The at least one wall cladding panel comprises a planar sheet having a first main face and a second main face separated from the first main face by a panel thickness approximately equal to the channel width. A portion of the wall cladding panel is disposed within the channel, and the channel retains the wall cladding panel in a position parallel to and spaced from the building substrate.

In one embodiment a building system is described, wherein the building system comprises a furring strip attached to a building substrate, the furring strip comprising a first member adjacent and parallel to the building substrate, a second member parallel to the first member and a web disposed between the first member and the second member to form a channel defined by a channel width, the first member and the second member being spaced apart by the channel width; and at least one wall cladding panel, the at least one wall cladding panel comprising a planar sheet having a first main face and a second main face separated from the first main face by a panel thickness approximately equal to the channel width, wherein a portion of the at least one wall cladding panel is disposed within the channel such that the channel retains the wall cladding panel in a position parallel to and spaced from the building substrate. Conveniently, the building substrate could be an interior or exterior building substrate. In one embodiment, each of the first member and the second member is an elongate member. Optionally, in another embodiment, each of the first member and the second member is a planar member. In a further embodiment, each of the first member and the second member is an elongate planar member.

In one embodiment, there is provided a rain screen system suitable for protecting an exterior building substrate from moisture, the rain screen system comprising: a furring strip made of a polymeric material, the furring strip comprising: a first member and a second member, wherein the first member is parallel to and spaced apart from the second member; and a web disposed between the first member and the second member, said web connecting the first and second members in a manner so as to form a channel defined by a channel width, the first member and the second member being spaced apart by the channel width; and at least one wall cladding panel comprising fiber cement, said wall cladding panel having a first main face and a second main face, the second main face being separated from the first main face by a panel thickness approximately equal to the channel width; wherein the rain screen system is mounted to the exterior building substrate in a manner such that the first member of the furring strip is positioned adjacent to the exterior building substrate and the second member extends outwardly from the exterior building substrate, wherein a portion of the wall cladding panel is disposed within the channel between the first and second members, and wherein the channel retains the wall cladding panel in a position parallel to and spaced from the building substrate such that the rain screen system can withstand an applied load of approximately 4.5 KPa (96 psf). The minimum applied load was calculated in accordance with ASTM E-330-02 (2010) Standard Test Method.

In a further embodiment, the exterior building substrate of the rain screen system comprises a weather resistant barrier adjacent to the first member. In one embodiment, the weather resistant barrier is disposed between the exterior building substrate and the first member. In another embodiment, the building substrate of the building system optionally further comprises a weather resistant barrier adjacent to the first member. In one embodiment, the weather resistant barrier is disposed between the building substrate and the first member. In one embodiment, each of the first member and the second member is an elongate member. Optionally, in another embodiment, each of the first member and the second member is a planar member. In a further embodiment, each of the first member and the second member is an elongate planar member.

In a further embodiment, the web, the first member and the second member of the furring strip form a first channel and a second channel, wherein the second channel is separated from the first channel by the web.

In one embodiment, the building system and/or rainscreen system further comprises the at least one wall cladding panel as a first wall cladding panel and at least one second wall cladding panel, a portion of the first wall cladding panel being disposed within the first channel and a portion of the second wall cladding panel being disposed within the second channel of the furring strip comprising a first and second channel. In further embodiments and as described further in the present disclosure, additional wall cladding panels and/or furring strips of the present disclosure can be used to extend the rainscreen system as desired by the end user.

In one embodiment, the height of each of the first member and the second member of the furring strip is between approximately 2.3 cm (0.9 inches) and approximately 7.6 cm (3 inches). In a further embodiment, the channel width of the furring strip is between approximately 0.6 cm (0.25 inches) and approximately 1.9 cm (0.75 inches). In one embodiment, the width of furring strip between opposing exterior surfaces of the first and second member remote the first channel ranges between approximately 0.75" (1.9 cm) and 1.25" (3.2 cm).

In one embodiment the at least one channel comprises a width approximately equal to or slightly greater than the thickness of the wall cladding panel for which it is configured to receive and retain. For example, the width of the at least one channel may be greater than the thickness of the wall cladding panel by approximately one sixteenth of an inch (0.0625" (0.16 cm)), approximately one eighth of an inch (0.125" (0.32 cm)), approximately one quarter of an inch (0.25" (0.64 cm)), or the like. It is preferable in all instances, that the width of the at least one channel is sufficiently large to receive the wall cladding panel whilst also maintaining a close enough fit so as to prevent the wall cladding panel from sliding or rotating out of the channel.

One advantage of certain building systems or rain screen systems of the present disclosure is that a furring strip which has a width of approximately 0.75" (1.9 cm) provides a sufficient air gap between the building substrate and the cladding panel to achieve a capillary break which allows for drainage and evaporation whilst also achieving a minimum applied load of approximately 4.5 KPa (96 psf). A furring strip which has a width of approximately 1.25" (3.2 cm) also achieves a minimum applied load of approximately 4.5 KPa (96 psf) and provides an air gap between the building substrate and the cladding panel to achieve a capillary break allowing for drainage and evaporation.

In another embodiment, a furring strip for mounting a wall cladding panel to a building substrate is described. The furring strip comprises a first member generally defined by a length along a first major axis and a height along a first minor axis perpendicular to the first major axis, a second member generally defined by a length along a second major axis parallel to the first major axis and a height along a second minor axis parallel to the first minor axis, and a web generally defined by a length along a third major axis parallel to the first major axis and the second major axis. The web is disposed between and spacedly couples the first member and the second member. The first member, the second member, and the web form at least one channel extending along the length of the web and configured to receive and retain a wall cladding panel. In one embodiment, each of the first member and the second member is an elongate member. Optionally, in another embodiment, each of the first member and the second member is a planar member. In a further embodiment, each of the first member and the second member is an elongate planar member.

The height of the first member can be equal to the height of the second member. The height of the first member can be greater than the height of the second member. The furring strip can be configured to be installable in either of a first user selectable configuration in which the first member is adjacent to the building substrate and a second user selectable configuration in which the second member is adjacent to the building substrate. The furring strip can further comprise a plurality of openings configured to receive a mechanical connector, each opening extending through the first member, the second member, and the web. Each of the first member and the second member can comprise an interior face adjacent to the channel, an exterior face, and two ends intermediate the interior face and the exterior face, and the ends of at least the first member can be tapered such that the height along the interior face of the first member is greater than the height along the exterior face of the first member. The lengths of the first member, the second member, and the web can be substantially equal and greater than or equal to 8 feet. Each of the height of the first member and the height of the second member can be between approximately 2.3 cm (0.9 inches) and approximately 7.6 cm (3 inches). The channel can have a width defined by the distance between the first member and the second member, the width of the channel being between approximately 0.6 cm (0.25 inches) and approximately 1.9 cm (0.75 inches).

In another embodiment, a furring strip for mounting a wall cladding panel to a building substrate is described, wherein the furring strip comprises a first member generally defined by a length along a first major axis and a height along a first minor axis perpendicular to the first major axis; a second member generally defined by a length along a second major axis parallel to the first major axis and a height along a second minor axis parallel to the first minor axis; and a web generally defined by a length along a third major axis parallel to the first major axis and the second major axis, wherein the web is disposed between and spacedly couples the first member and the second member such that the first member, the second member and the web form at least one channel extending along the length of the web, wherein the at least one channel is configured to receive and retain a wall cladding panel. In one embodiment, the channel comprises a width defined by the distance between the first member and the second member, the width of the channel being between approximately 0.6 cm (0.25 inches) and approximately 1.9 cm (0.75 inches).

In one embodiment of the furring strip, the height of the first member is equal to the height of the second member. In a further embodiment of the furring strip, the height of the first member is greater than the height of the second member. In one embodiment, the furring strip is configured to be installable in either of a first user selectable configuration in which the first member is adjacent to a building substrate or a second user selectable configuration in which the second member is adjacent to a building substrate. Conveniently, the building substrate is an interior or an exterior building substrate. In another embodiment, the furring strip further comprises a plurality of openings configured to receive a mechanical connector, each opening extending through the first member, the second member and the web of the furring strip.

In a further embodiment, each of the first member and the second member of the furring strip comprises an interior face adjacent to the channel, an exterior face remote from the channel and two ends intermediate the interior face and the exterior face. In one embodiment the ends of at least the first member are tapered such that the height along the interior face of the first member is greater than the height along the exterior face of the first member. In one embodiment, the height of each of the first member and the second member is between approximately 2.3 cm (0.9 inches) and approximately 7.6 cm (3 inches). In one embodiment, each of the first member and the second member is an elongate member. Optionally, in another embodiment, each of the first member and the second member is a planar member. In a further embodiment, each of the first member and the second member is an elongate planar member.

In a further embodiment, the lengths of the first member, the second member, and the web along a first major axis can be substantially equal and greater than or equal to 2.44 meters (8 feet).

In a further embodiment, the furring strip comprises a polymeric material. Conveniently the polymeric material is a durable polymer composite material which is waterproof, nailable and dimensionally stable, such as, for example a fiber reinforced polymer or a glass reinforced plastic. It is preferable for the polymer composite material to have limited thermal expansion and contraction when exposed to environmental conditions when in use in the field. It is also preferable for the durable polymer composite material to exhibit little to no carbonation shrinkage or moisture movement when exposed to environmental conditions when in use in the field. In one embodiment of the furring strip, the thermal expansion of the extruded polymeric thermoplastic composite material corresponds to between 9 and 18 cm/cm/° C. (5 and $10\times10^{-6}$ in/in/F). Conveniently, the durable polymer composite material can also be resistant to nail withdrawal. In one embodiment, the durable polymer composite material is a thermoplastic or thermoset composite material. In a further embodiment, the durable polymer composite material has a thermal break value R 2.5 or greater.

It is to be understood that the various embodiments of the furring strip of the present disclosure is suitable for use in either the building system or the rainscreen system described herein.

In another embodiment, a method of mounting a wall cladding panel to a building substrate is described, wherein the building substrate is either of an interior building substrate or an exterior building substrate. The method of mounting a wall cladding panel to the building substrate comprising the steps of:

a) obtaining a wall cladding panel, wherein the wall cladding panel comprising a planar sheet having a first main face and a second main face separated from the first main face by a panel thickness;
b) obtaining a first furring strip comprising a first member, a second member parallel to the first member, and a web disposed between the first member and the second member to form a channel having a channel width approximately equal to the panel thickness,
c) fixing the first furring strip to the building substrate; and
d) placing a portion of the wall cladding panel into the channel to retain the wall cladding panel in a position parallel to and spaced from the building substrate.

In one embodiment, the method of mounting a wall cladding panel to the building substrate optionally comprises a further step (c1) after step (c), wherein step (c1) comprises the step of fixing a second furring strip to the building substrate such that the first furring strip and the second furring strip are arranged in a parallel, spaced apart configuration on the building substrate.

In one embodiment, step (c) of fixing the first furring strip to the building substrate and/or step (c1) of fixing a second furring strip to the building substrate each comprise, placing the first member or the second member against the building substrate, and securing a fastener through the second member, the web, and the first member to secure the first furring strip to the building substrate.

In one embodiment, each of the first member and the second member is an elongate member. Optionally, in another embodiment, each of the first member and the second member is a planar member. In a further embodiment, each of the first member and the second member is an elongate planar member.

In one embodiment, the at least one wall cladding panel comprises a fiber cement cladding article. In a further embodiment, the furring strip comprises a fiber cement article.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

Various embodiments of the building system will be described in greater detail below.

DETAILED DESCRIPTION OF THE PREFERRED EMBODIMENT

References will now be made to the drawings wherein like numerals refer to like parts throughout.

Figures 1A, 1B, 1C, 1D, 1E:
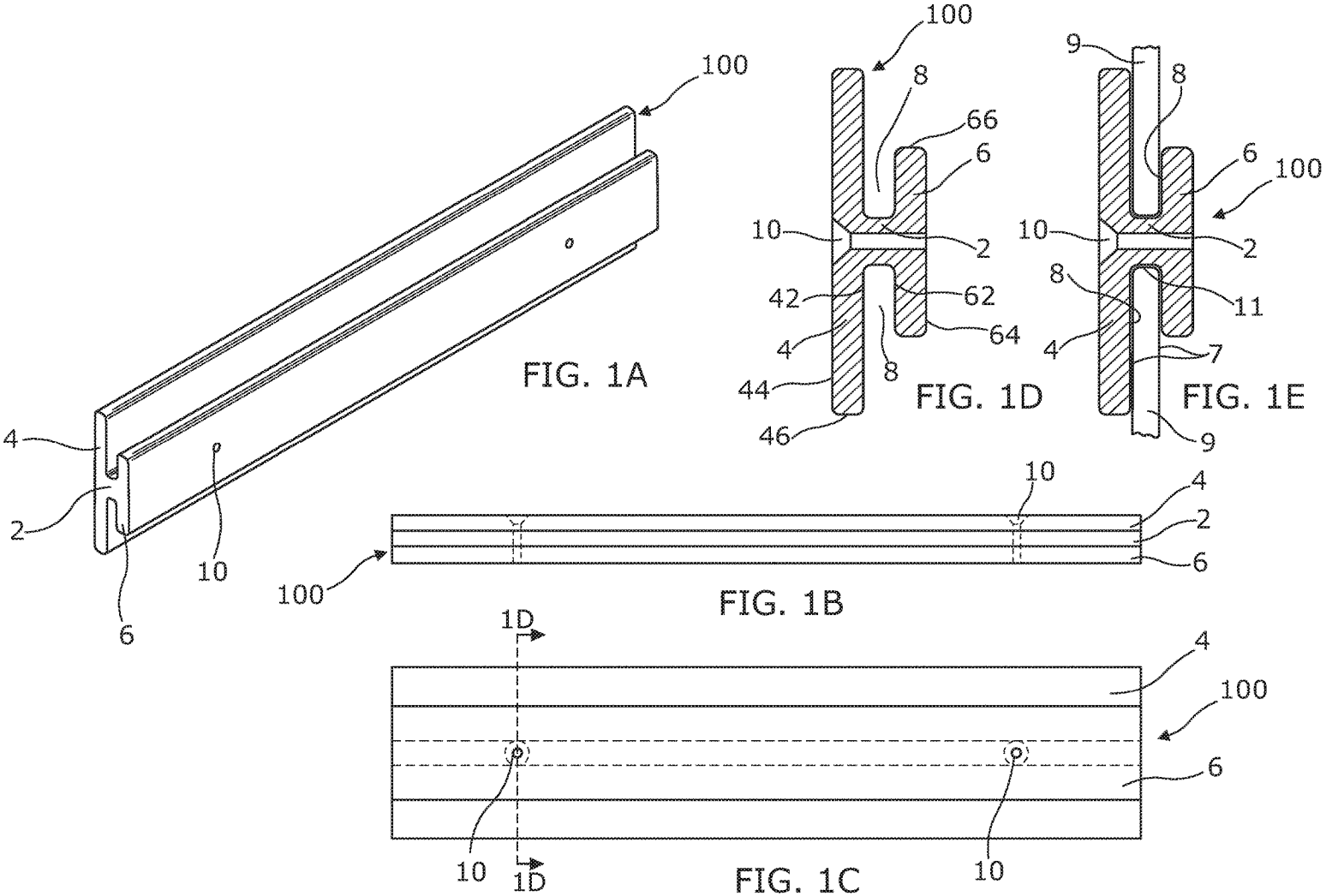
FIG. 1A is a perspective view of a furring strip of one embodiment of the present disclosure.
FIG. 1B is a top view of the furring strip of FIG. 1A.
FIG. 1C is a front view of the furring strip of FIG. 1A.
FIG. 1D is a cross-sectional side view of the furring strip of FIG. 1A, taken about the line 1D-1D in FIG. 1C.
FIG. 1E is the cross-sectional side view of FIG. 1D showing the furring strip of FIG. 1A together with two fiber cement cladding articles installed therein.

Each of FIGS. 1A to 1D show views of a furring strip 100 according to one embodiment. Furring strip 100 comprises a web 2 with opposing first and second edges, a first member 4 extending from a first edge and a second members 4, 6 extend perpendicularly from opposing edges of web 2 respectively and are configured such that the first and second members 4, 6 extend substantially parallel to each other thereby forming a channel 8. Referring specifically to FIG. 1D, web 2 forms the base member of channel 8 and the first and second members 4, 6 form the side members of channel 8, thereby forming a u-shaped channel 8. In the embodiment shown in FIG. 1D, a u-shaped channel 8 is formed on either side of web 2. Conveniently each u-shaped channel 8 of furring strip 100 is sized and shaped to accommodate a building cladding article 9 as shown in FIG. 1E. In one embodiment, first and second members 4, 6 of furring strip 100 are elongate and/or planar first and second members 4, 6. Openings 10 extend through the first member 4, the second member 6, and the web 2, and are configured to accommodate a mechanical fastener for securing furring strip 100 to a building substrate adjacent to the first member 4 or the second member 6.

In one embodiment, building cladding article 9 comprises a fiber cement cladding article, wherein the fiber cement building cladding article comprises a panel or sheet which have two opposing main faces 7 and an edge member 11 extending therebetween and around the periphery of the opposing main faces 7 to form the panel or sheet. The distance between the two opposing main faces 7 defines a building cladding article thickness. Other possible forms and/or configurations of building or cladding articles may also be used in conjunction with furring strip 100.

In one embodiment, furring strip 100 is approximately 12 ft (3.65 meters) long. The furring strip can also be made to approximately 8 ft (2.43 m), approximately 16 ft (4.87 m) or other custom lengths as desired by the end user.

In one embodiment, the heights of each of the first member 4 and second member 6 range between approximately 0.9" (0.02 m) and approximately 2.75" (0.07 m). Referring specifically to the embodiment shown in FIGS. 1A-1E, the heights of first member 4 and second member 6 are 2.75" (0.07 m) and 1.5" (0.04 m) respectively.

In one embodiment, the thickness or width of each of the first and second member 4, 6 ranges between 0.25" (0.635 cm) and 0.375" (0.95 cm).

In one embodiment, the u-shaped channel 8 formed between first and second members 4 and 6 has a width which approximately equal to or slightly greater than the thickness of the wall cladding panel for which it is configured to receive and retain. In one embodiment the width of u-shaped channel 8 ranges between approximately 0.25" (0.6 cm) and 0.75" (1.9 cm), wherein the width is defined as the distance between the innermost faces 42, 62 of first and second members 4, 6 respectively. It is to be understood that the innermost face of first member 4 is the face of first member 4 which is adjacent u-shaped channel 8 and the innermost face of second member 6 is the face of second member 6 which is adjacent u-shaped channel 8. In certain embodiments, it is preferable for the width of u-shaped channel 8 to be greater than the thickness of the wall cladding panel by approximately one sixteenth of an inch (0.0625" (0.16 cm)), approximately one eighth of an inch (0.125" (0.32 cm)), approximately one quarter of an inch (0.25" (0.64 cm)), or the like. Referring specifically to the embodiment shown in FIGS. 1A-1E, each u-shaped channel 8 formed between first and second members 4 and 6 has a width which is approximately 0.25" (0.6 cm) wide.

In one embodiment the thickness or width of furring strip 100, specifically, the distance between the outermost faces 44, 64 of first and second members 4 and 6 ranges between approximately 0.75" (1.9 cm) and 1.25" (3.2 cm). It is to be understood that the outermost face of first member 4 is the face of first member 4 which is remote from u-shaped channel 8 and the outermost face of second member 6 is the face of second member 6 which is remote from u-shaped channel 8. Referring specifically to the embodiment shown in FIGS. 1A-1E, the width of furring strip 100, specifically, the distance between the outermost faces 44, 64 of first and second members 4 and 6 is approximately 0.75" (1.9 cm). In the embodiment shown in FIGS. 1A-1E, each of the edges 46, 66 of furring strip 100 is rounded to remove sharp edges and thereby improve workability for the end user.

Furring strip 100 may advantageously exhibit better resistance to nail withdrawal than wood at an equivalent thickness. Testing has shown that a furring strip of the present disclosure having a thickness of 0.1875" (0.48 cm) can achieve the equivalent resistance to nail withdrawal as a section of Oriented Strand Board (OSB) having a thickness of 0.4375" (1.11 cm).

As shown in FIG. 1E, the width of each u-shaped channel 8 is approximately equal to the thickness of the building cladding article 9 along edge member 11 such that the building cladding article 9 can be retained in place by the furring strip 100 without the need of additional fasteners to secure the building cladding article 9 to the furring strip 100. A u-shaped channel 8 having a width approximately equal to the thickness of the building cladding article 9 can have a width exactly equal to the thickness of the building cladding article 9 or slightly greater than the thickness of the building cladding article 9. For example, the width of the u-shaped channel 8 may be greater than the thickness of the building cladding article 9 by approximately one sixteenth of an inch (0.0625" (0.16 cm)), approximately one eighth of an inch (0.125" (0.32 cm)), approximately one quarter of an inch (0.25" (0.64 cm)), or the like, while maintaining a close enough fit so as to prevent the building cladding article 9 from sliding or rotating out of the u-shaped channel 8. Conveniently, in the embodiment shown in FIGS. 1A-1E, the width formed between first and second members 4, 6 is approximately 0.6 cm (0.25")±one sixteenth of an inch (0.16 cm) (0.625") wide which is approximately equal to the thickness of a conventional fiber cement cladding panel or sheet.

Furring strips described herein generally have a length along a major axis, and first and second members defined generally by a length along a major axis and a height along a minor axis. For example, in the embodiments depicted in FIGS. 1A-1C, openings 10 are spaced along the length of the furring strip 100. The minor axis is generally perpendicular to the major axis, and parallel to a building substrate and cladding panels as installed. For example, the first member 4 and second member 6 as depicted in the embodiment of FIG. 1A have the same thickness and length, but have different heights along their minor axes.

Referring now to FIGS. 2A to 2D, each of FIGS. 2A to 2D show a furring strip 200 according to a second embodiment. Furring strip 200 is configured to accommodate fiber cement cladding articles which are thicker than conventional fiber cement cladding articles. Specifically, the u-shaped channels 8*a* of furring strip 200 have an opening which is approximately 0.375" (0.95 cm) in width. Thus, in use, it is possible to seat a fiber cement cladding article which has a thickness of approximately 0.375" (0.95 cm) or less within channels 8*a*. In one example, Hardie Panel® fiber cement cladding article can be inserted into the u-shaped channel 8*a* of furring strip 200. The total width of furring strip 200, specifically, the distance between the outermost faces of first and second members 4*a* and 6*a* remote from the u-shaped channel 8*a* is approximately 1.125" (2.86 cm). Each of first and second members 4*a* and 6*a* are slightly thicker than the corresponding first and second members 4 and 6 of furring strip 100 depicted in FIGS. 1A-1E to securely support and retain a thicker fiber cement cladding article. As before, furring strip 200 is approximately 12 ft (3.65 meters) long and the heights of first members 4*a* and second members 6*a* are 2.75" (0.07 m) and 1.5" (0.04 m) respectively.

Figures 2A, 2B, 2C, 2D:
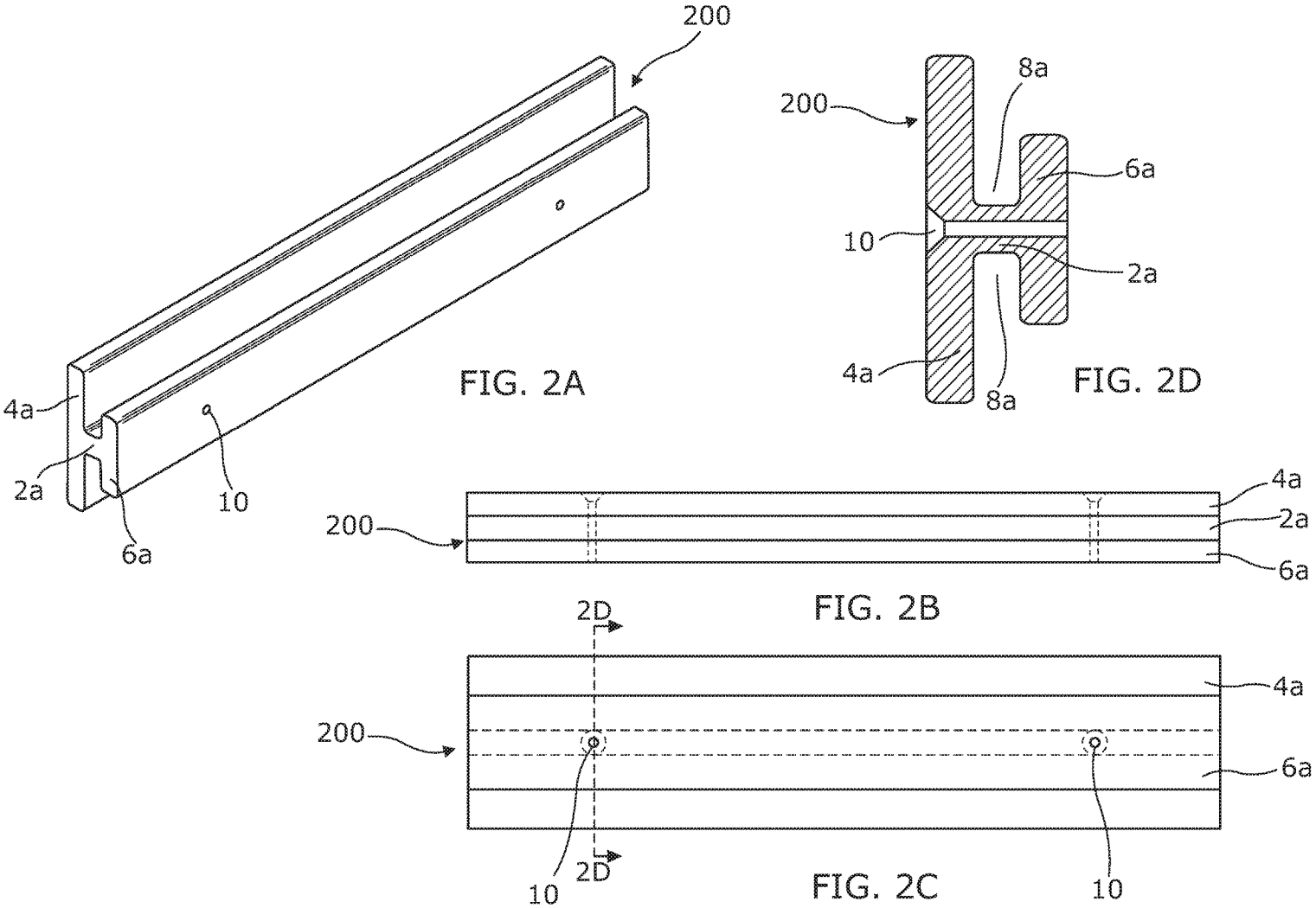
FIG. 2A is a perspective view of a furring strip of a second embodiment of the present disclosure.
FIG. 2B is a top view of the furring strip of FIG. 2A.
FIG. 2C is a front view of the furring strip of FIG. 2A.
FIG. 2D is a cross-sectional side view of the furring strip of FIG. 2A, taken about the line 2D-2D in FIG. 2C.
Figure 2G:
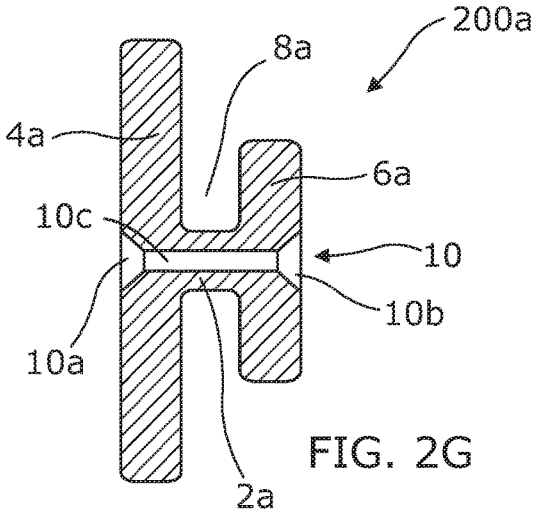
FIG. 2G is a cross-sectional side view of the alternate embodiment of the furring strip of FIG. 2A as shown in FIG. 2E, taken about the line 2G-2G in FIG. 2F.
Figure 2E:
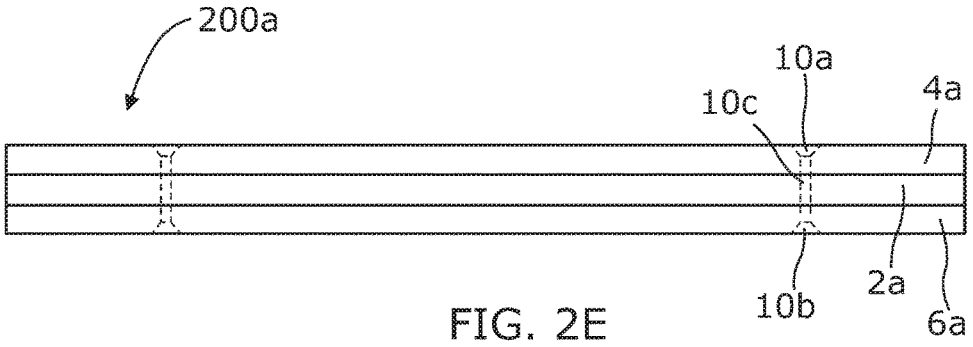
FIG. 2E is a top view of an alternate embodiment of the furring strip of FIG. 2A.
Figure 2F:
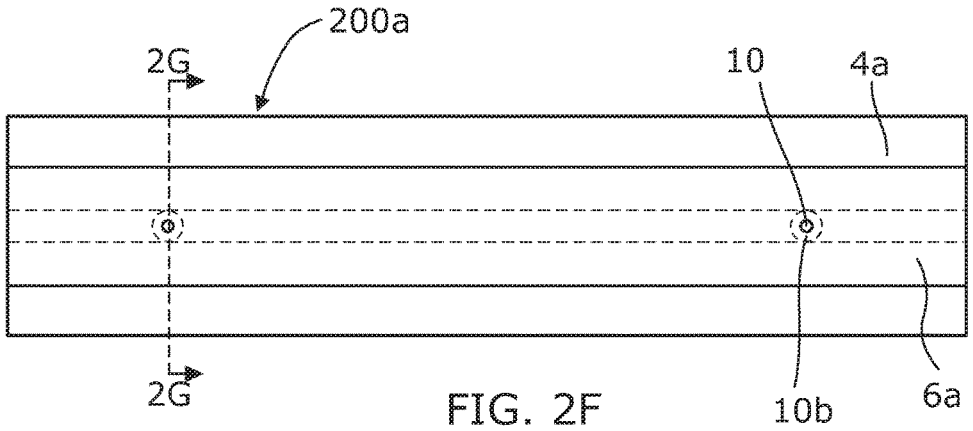
FIG. 2F is a front view of the alternate embodiment of the furring strip of FIG. 2A as shown in FIG. 2E.
Figures 3A, 3B, 3C, 3D:
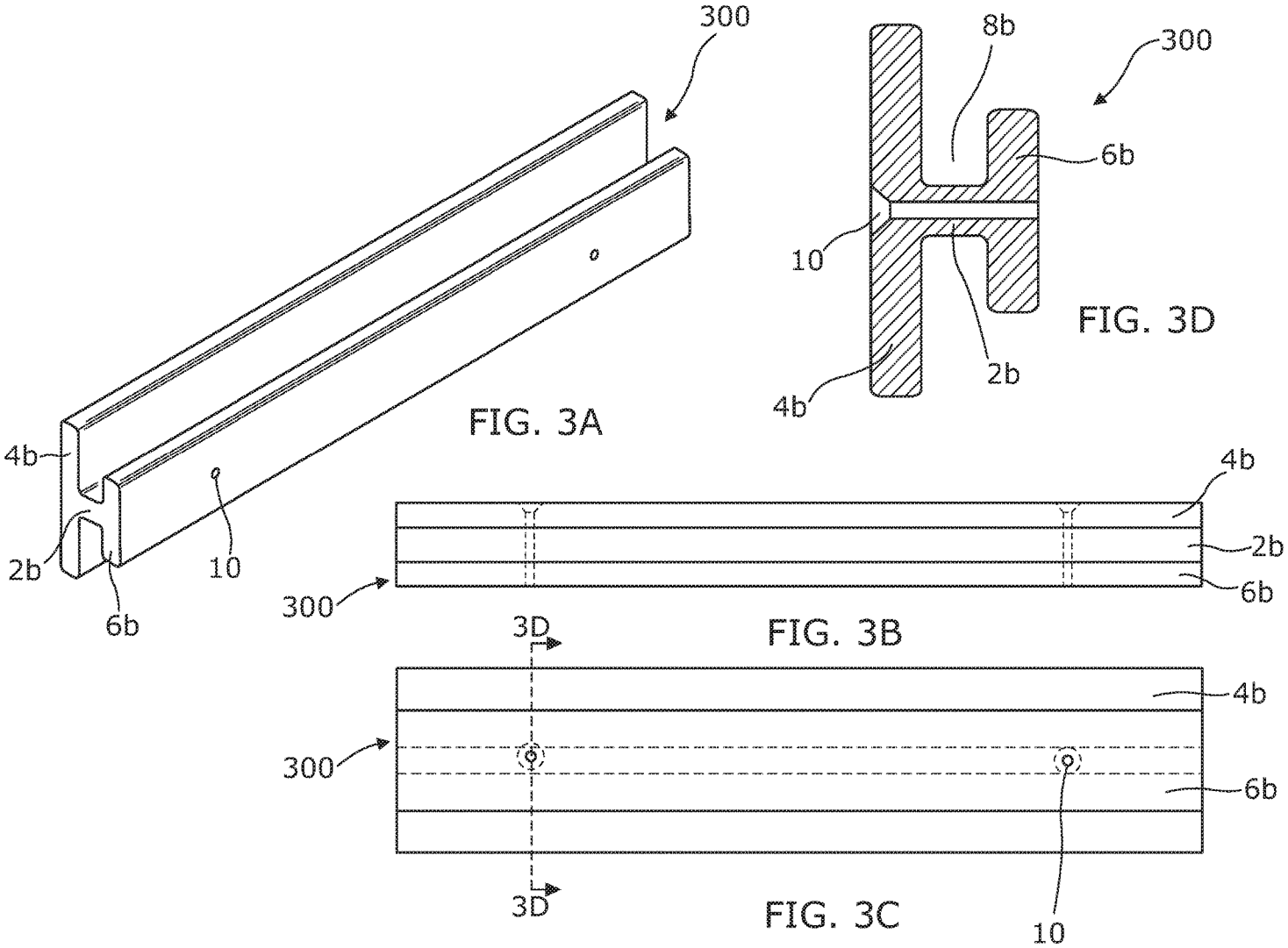
FIG. 3A is a perspective view of a furring strip of a third embodiment of the present disclosure.
FIG. 3B is a top view of the furring strip of FIG. 3A.
FIG. 3C is a front view of the furring strip of FIG. 3A.
FIG. 3D is a cross-sectional side view of the furring strip of FIG. 3A, taken about the line 3D-3D in FIG. 3C.

A further embodiment of the furring strip 200*a* is shown in FIGS. 2E to 2G. This embodiment of the furring strip comprises an opening 10. Opening 10 comprises two recessed tapered openings 10*a* and 10*b* and a conduit 10*c* positioned there between. Recessed tapered opening 10*a* is positioned on the outermost face of first member 4*a* remote from u-shaped channel 8*a*. Recessed tapered opening 10*b* is positioned on the outermost face of second member 6*a* remote from u-shaped channel 8*a*. This configuration of opening 10 allows furring strip 200*a* to be attached to a building substrate such that a fastener can be recessed within the furring strip 200*a* irrespective of which outermost face i.e. the outermost face of first member 4*a* or the second member 6*a* is adjacent the building substrate. As in FIGS. 2A-2D, furring strip 200*a* can be approximately 12 ft (3.65 meters) long and the heights of first members 4*a* and second members 6*a* can be 2.75" (0.07 m) and 1.5" (0.04 m) respectively.

Referring now to FIGS. 3A to 3D, each of FIGS. 3A to 3D show a further embodiment of the furring strip 300. Furring strip 300 is configured to accommodate fiber cement cladding articles which have a thickness of approximately 0.5" (1.27 cm) thick. U-shaped channels 8*b* have an opening which is approximately 0.5" (1.27 cm) wide to accommodate such a fiber cement cladding article. The distance between the outermost faces of first and second members 4*b* and 6*b* remote from the u-shaped channel 8*b* and the innermost faces of first and second members 4*b* and 6*b* adjacent the u-shaped channel 8*b* is approximately 0.375" (0.95 cm). The total distance between the outermost faces of first and second members 4*b* and 6*b* is 1.25" (3.2 cm). Furring strip 300 is approximately 12 ft (3.65 meters) and the heights of first member 4*b* and second member 6*b* are 2.75" (0.07 m) and 1.5" (0.04 m) respectively.

Figures 4A, 4B, 4C:
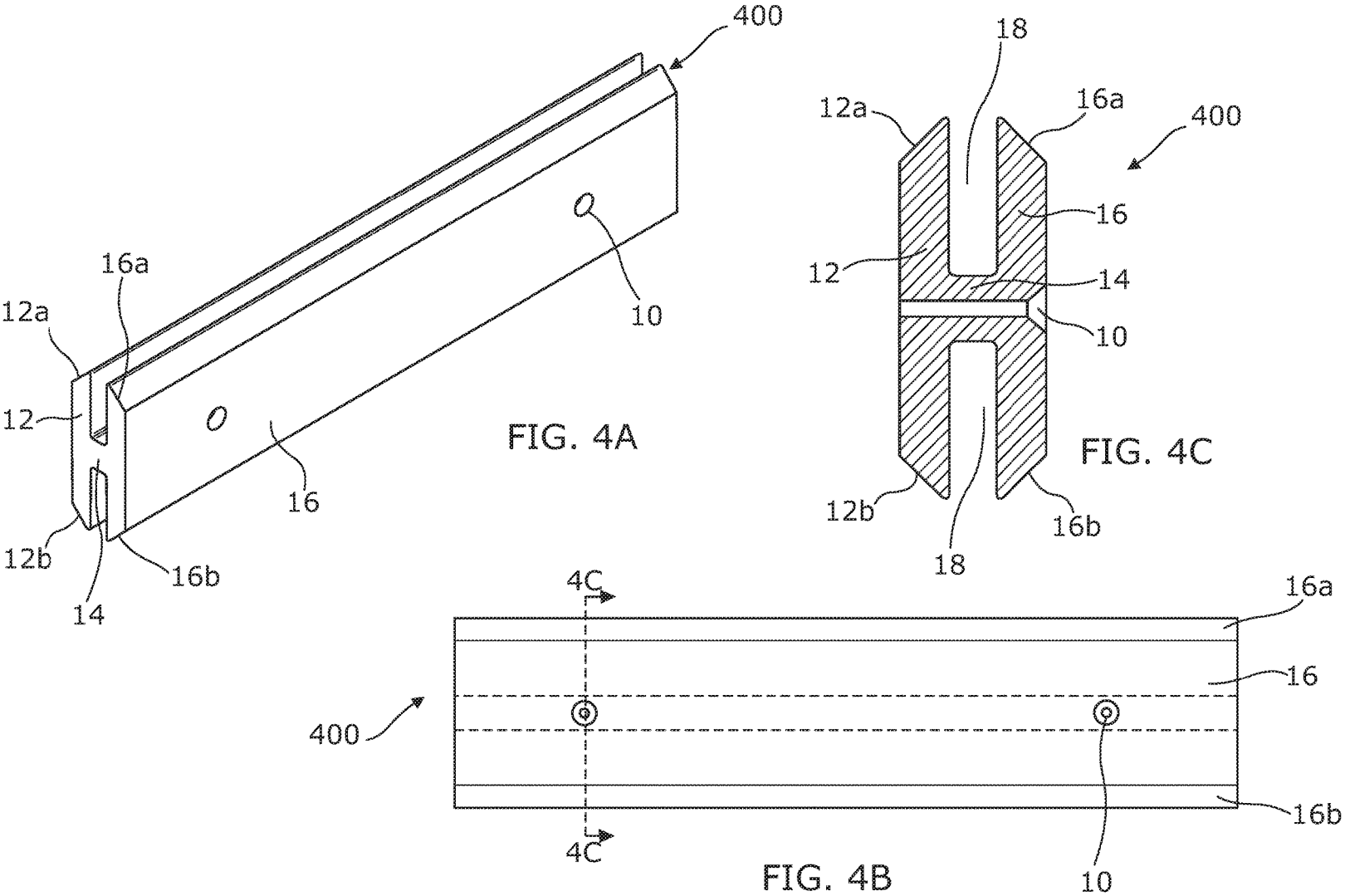
FIG. 4A is a perspective view of a furring strip of a fourth embodiment of the present disclosure.
FIG. 4B is a front view of the furring strip of FIG. 4A.
FIG. 4C is a cross-sectional side view of the furring strip of FIG. 4A, taken about the line 4C-4C in FIG. 4B.

Turning now to FIGS. 4A-4C, there is shown a further embodiment of furring strip 400. Furring strip 400 comprises a web 14 with opposing first and second edges, a first member 12 extending from a first edge and a second member 16 extending from a second edge, whereby first and second members 12, 16 extend perpendicularly from opposing edges of web 14 respectively and are configured such that the first and second members 12, 16 extend substantially parallel to each other. A u-shaped channel 18 is formed on either side of the web 14. Furring strip 400 is approximately 12 ft (3.65 meters) long. The heights of first member 12 and second member 16 are substantially equivalent. First and second members 12 and 16 are provided with ends 12*a*, 12*b*, 16*a*, 16*b* positioned between the innermost and outermost faces of first and second members 12 and 16. Ends 12*a*, 12*b*, 16*a*, 16*b* are tapered such that the height of the outermost faces of the first and second members 12, 16 is lower than that of the height of the innermost faces of the first and second members 12, 16.

In the embodiment shown, the height of the outermost faces of the first and second members 12, 16 is 2.25" (0.06 m) and the height of the innermost faces of the first and second members 12, 16 is 2.91" (0.07 m). Conveniently, each end portion is angled to accommodate the difference in height between the innermost and outermost faces of first and second members 12, 16. In one embodiment the angle is approximately 45°. Each u-shaped channel 18 formed between first and second members 12 and 16 has an opening wherein the distance between the innermost faces of first and second members 12,16 is approximately 0.375" (0.95 cm) wide. Furring strip 400 is provided with opening 10 to accommodate mechanical fasteners. When a fiber cement cladding article is inserted into the u-shaped channel 18 of FIGS. 4A-4C, tapered ends 12*a*, 12*b*, 16*a*, 16*b* are seated adjacent to opposing surfaces of the fiber cement cladding article. In one embodiment the tapered ends 12*a*, 12*b*, 16*a*, 16*b* aid in the management of, for example, dirt, debris and/or water and in directing such materials away from the surfaces of the fiber cement cladding article 9.

Figure 5D:
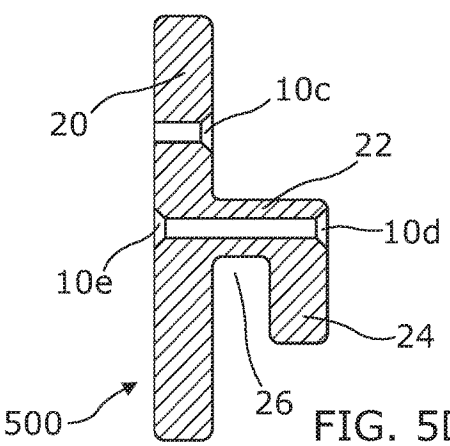
FIG. 5D is a cross-sectional side view of the furring strip of FIG. 5A, taken about the line 5D-5D in FIG. 5C.

Referring now to FIGS. 5A to 5D, each of FIGS. 5A to 5D show furring strip 500. Furring strip 500 comprises a web 22 with opposing first and second edges, a first member 20 extending from a first edge and a second member 24 extending from a second edge. In the embodiment shown, first and second members 20, 24 extend perpendicularly from opposing edges of web 22 respectively and are configured such that the first and second members 20, 24 extend substantially parallel to each other. The heights of first member 20 and second member 24 are 2.75" (0.07 m) and 0.91" (0.02 m) respectively. In this embodiment of the furring strip only one u-shaped channel 26 is formed. Referring specifically to FIG. 5D, it is shown that web 22 forms the base member and the first and second members 20, 24 form the side members respectively of u-shaped channel 26. As before, u-shaped channel 26 can be sized and shaped to accommodate a fiber cement building article. Furring strip 500 is provided with a number of openings 10 which have tapered recesses 10*c*, 10*d* and 10*e* to accommodate mechanical fasteners (not shown).

Figure 5A:
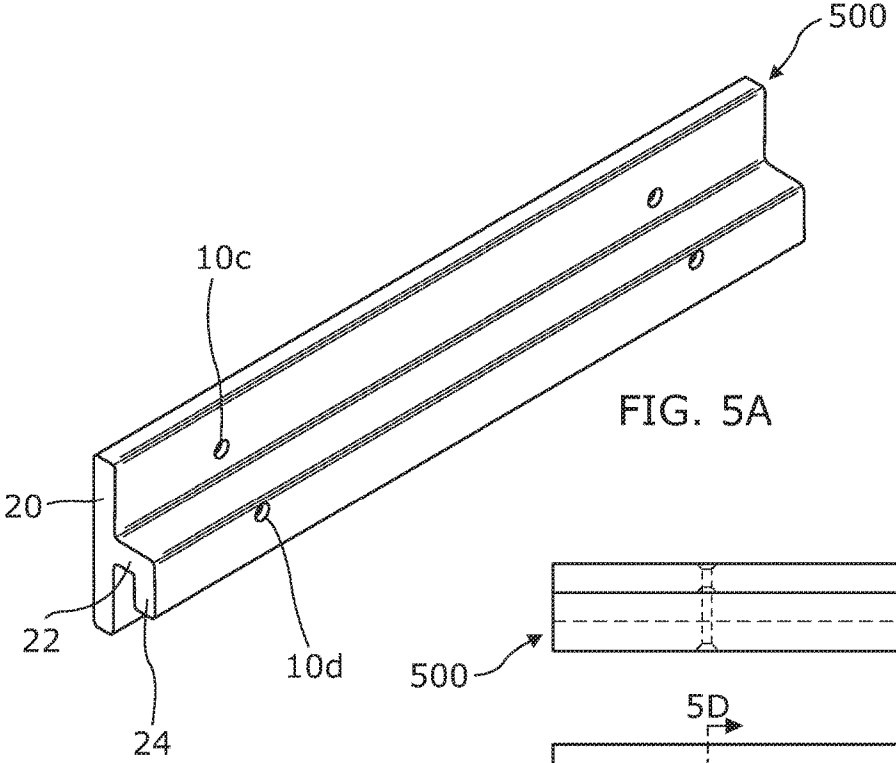
FIG. 5A is a perspective view of a furring strip of a fifth embodiment of the present disclosure.
Figure 5B:
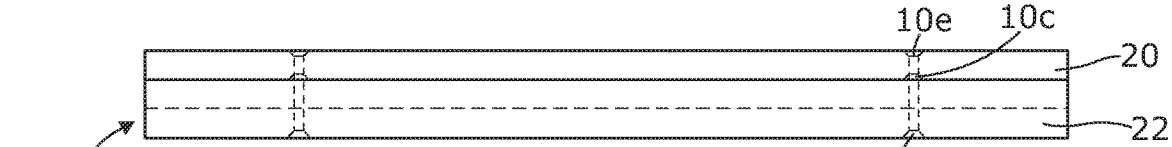
FIG. 5B is a top view of the furring strip of FIG. 5A.
Figure 5C:
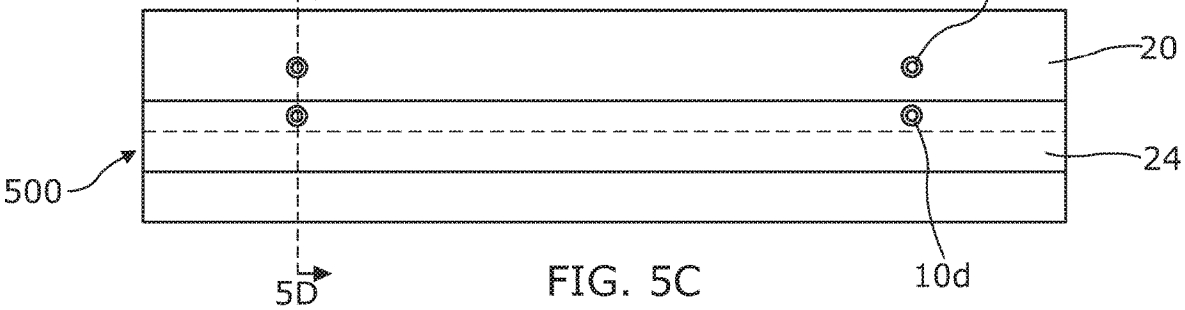
FIG. 5C is a front view of the furring strip of FIG. 5A.
Figures 6A, 6B, 6C:
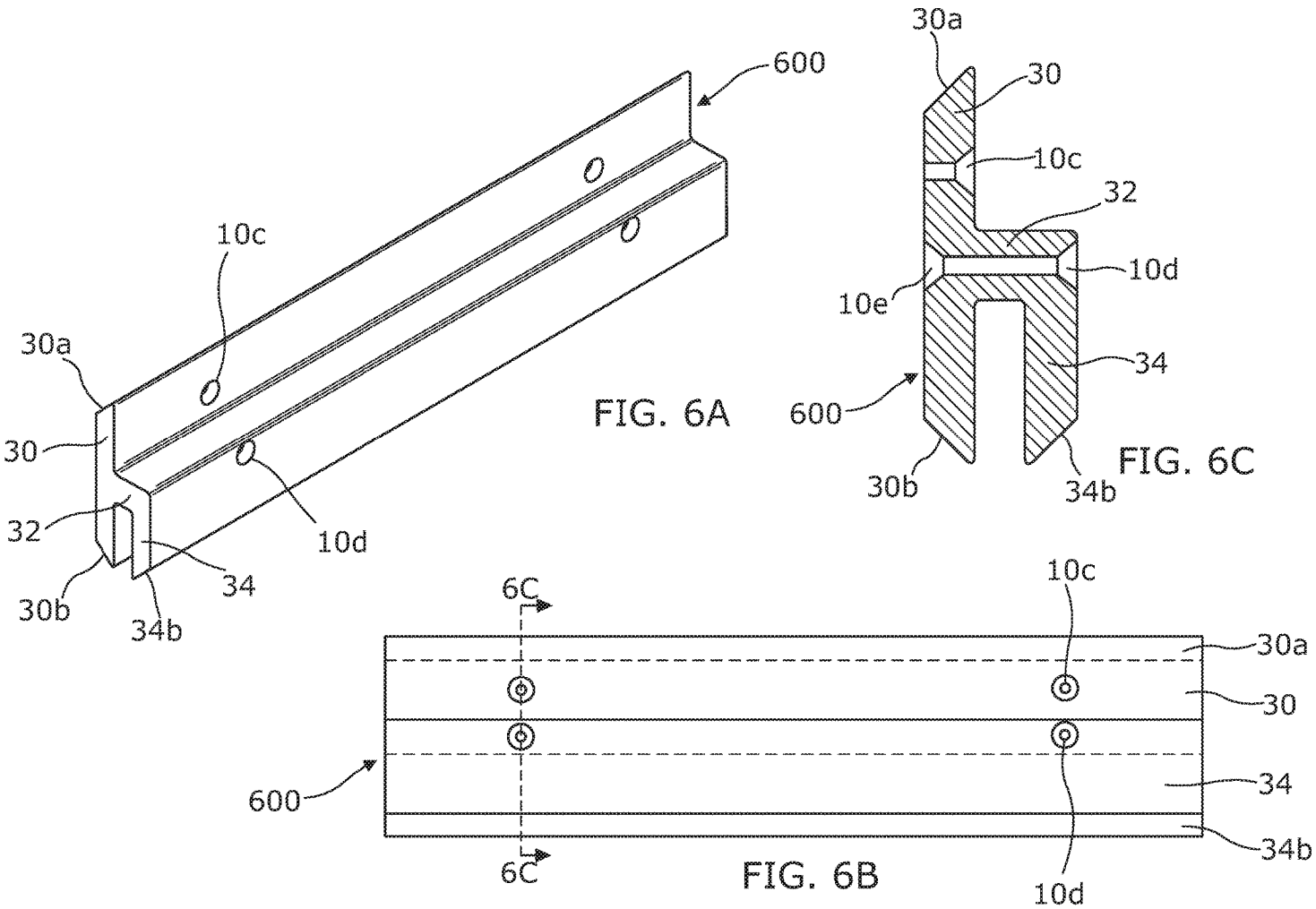
FIG. 6A is a perspective view of a furring strip of a sixth embodiment of the present disclosure.
FIG. 6B is a front view of the furring strip of FIG. 6A.
FIG. 6C is a cross-sectional side view of the furring strip of FIG. 6A, taken about the line 6C-6C in FIG. 6B.
Figure 7D:
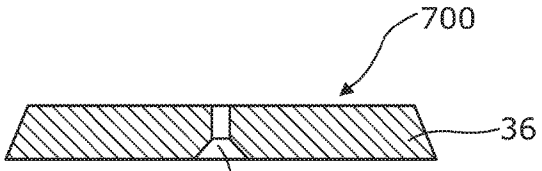
FIG. 7D is an enlarged cross-sectional side view of the furring strip of FIG. 7A, taken about the line 7D-7D in FIG. 7C.
Figure 7C:
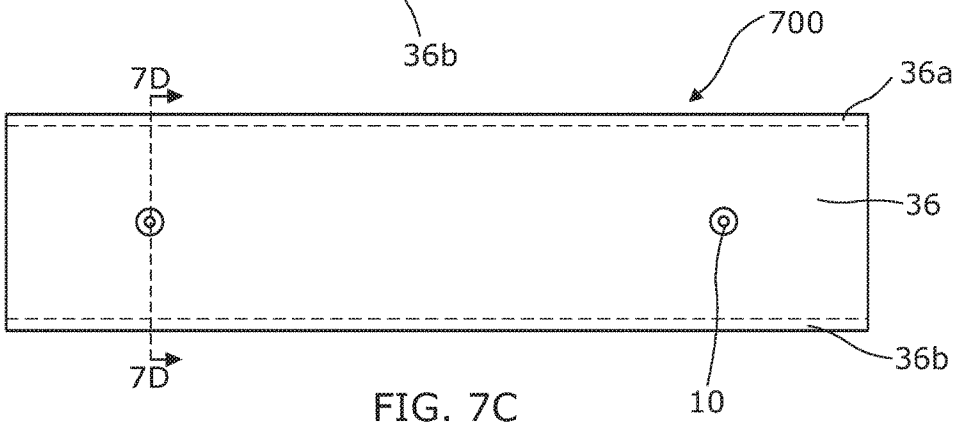
FIG. 7C is a front view of the furring strip of FIG. 7A.
Figure 7A:
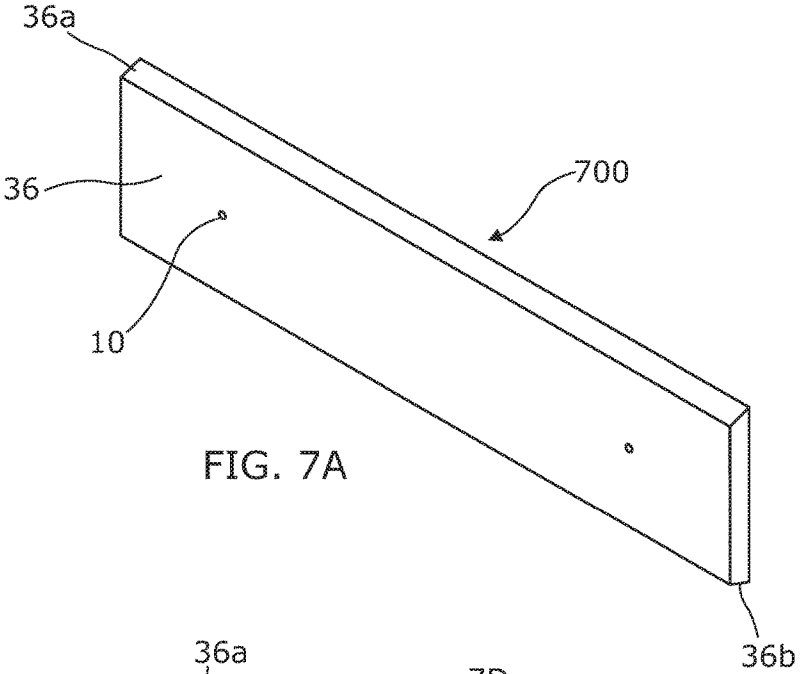
FIG. 7A is a perspective view of a furring strip of a further embodiment of the present disclosure.
Figure 7B:
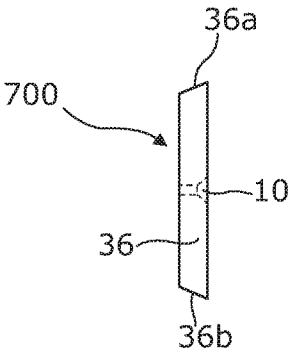
FIG. 7B is a side view of the furring strip of FIG. 7A.

Turning now to FIGS. 6A to 6C, there is provided a further embodiment of the furring strip. Furring strip 600 is similar to furring strip 500 depicted in FIGS. 5A-5C however it is provided with tapered ends 30*a*, 30*b* and 34*b*.

Referring to FIGS. 7A to 7D, there is shown a further embodiment of the furring strip. Furring strip 700 comprises a first member 36 which has a plurality of openings 10 for securing the furring strip to a building substrate (not shown) and tapered edges 36*a* and 36*b*.

Optionally in a further embodiment, the web of each furring strip described herein further comprises one or more drainage channels to facilitate drainage of fluids from the u-shaped channel of the furring strip.

Although each of the various embodiments have been described with respect to specific dimensions and configurations, it is to be understood that there is a tolerance of approximately one sixteenth of an inch (0.0625" (0.16 cm)), approximately one eighth of an inch (0.125" (0.32 cm)), approximately one quarter of an inch (0.25" (0.64 cm)), or the like as appropriate for each of the various channel widths to accommodate any possible variations in the fiber cement cladding article(s).

It is also possible to taper or flatten the end sections of the first and second members of each of the described embodiments of the furring strip if so desired.

Figure 8:
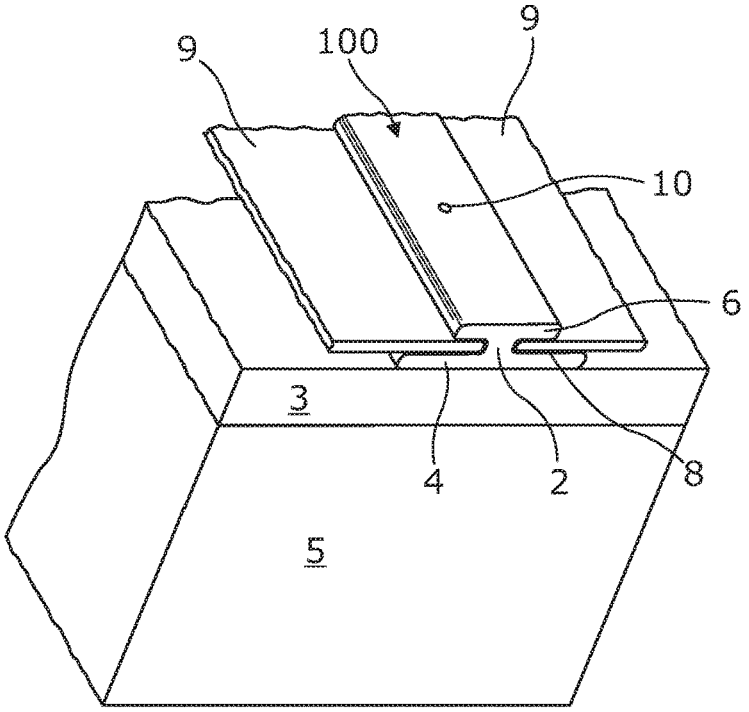
FIG. 8 is a perspective sectional view of one embodiment of the furring strip of FIG. 1A installed on a building substrate.

FIG. 8 shows one example of the furring strip 100 in use. Furring strip 100 can be attached to a building substrate 5 such that the outermost face of first member 4 is positioned adjacent to the building substrate 5 and/or a weather resistant barrier 3 whilst the outermost face of second member 6 is positioned furthest from building substrate 5. Although not shown, it is possible to reverse this orientation if desired whereby furring substrate 100 is attached to a building substrate 5 such that the outermost face of second member 6 is positioned adjacent to the building substrate 5 and/or weather resistant barrier 3 whilst the outermost face of first member 4 is positioned furthest from the building substrate 5.

Conveniently, furring strip 100 is configured such that a number of methods of attaching the fiber cement cladding article 9 to a building substrate 5 are accommodated.

Referring specifically to FIG. 8, one embodiment of the building system is shown. In this configuration, furring strip 100 is attached to the building substrate 5 via the first member 4 and the fiber cement cladding article 9 is inserted into the u-shaped channel 8. A weather resistant barrier 3, for example house wrap, is placed between the building substrate 5 and the furring strip 100. Furring strip 100 functions as a spacer between the building substrate 5 and the fiber cement cladding article 9. Thus the building system forms a rain screen system whereby a gap is formed between the fiber cement cladding article 9 and the building substrate 5 creating a capillary break allowing drainage and evaporation. The weather resistant barrier 3 provides a moisture barrier against ingress of water whilst allowing water vapor to pass to the exterior environment. The gap created by furring strip 100, between building substrate 5 and fiber cement cladding article 9 is approximately 0.39" (10 mm) or greater. Second member 6 of furring strip 100 can provide additional means to secure the fiber cement cladding article 9 to the building substrate 5. The configuration of the furring strip 100 and specifically, the dimensions of the u-shaped channel 8 and the first and second members 4, 6 operate to retain and provide additional support for the fiber cement cladding article 9 when placed within the u-shaped channel 8 of the furring strip 100.

Furring strip 100 can be provided with one or more openings 10 to accommodate mechanical fasteners (not shown) for securing furring strip 100 to building substrate 5. Openings 10 are in the form of recessed tapered openings which are designed to accommodate tapered heads on, for example, nail or screw fasteners, however it is to be understood that opening 10 can take any desired form to accommodate other types of suitable fasteners. It is also to be understood that openings 10 are optional and in some embodiments of the present disclosure, it may be desirable to secure furring strip 100 to a building substrate 5 using concealed fastening means or chemical fasteners such as, for example, adhesives. It is also possible to use a combination of mechanical and chemical fasteners to secure furring strip 100 to building substrate 5. In a further embodiment, one or more of openings 10 are also configured to receive mechanical fasteners for securing the fiber cement cladding articles 9 to the furring strip 100.

With continued reference to FIG. 8, a method of installing one or more furring strips to mount wall cladding panels to a building substrate 5 will now be described. One or more furring strips 100, such as a furring strip according to any of the embodiments described herein, can be obtained. A plurality of wall cladding panels 9, such as fiber cement panels, or the like, can also be obtained for mounting to the building substrate 5. The building substrate 5 may be prepared by adding a weather resistant barrier 3. A first furring strip 100 can then be fixed to the building substrate 5 by a mechanical or chemical adhesive. For example, the furring strip 100 can be glued to the building substrate 5 or weather resistant barrier 3, or a nail, screw, or other mechanical fastener can be driven through the furring strip 100, such as through a pre-existing opening 10 or through any other portion of the furring strip, into the building substrate 5. In various embodiments, a series of mechanical fasteners may be driven through the furring strip 100 at spaced locations along the length of the furring strip 100 to securely fix the entire furring strip 100 to the building substrate 5.

After the furring strip 100 is secured to the building substrate 5, one or more wall cladding panels 9 may be mounted by placing the wall cladding panels 9 into u-shaped channels 8 of the furring strip 100. In the embodiment depicted in FIG. 8, the furring strip 100 includes two u-shaped channels 8. Accordingly, at least two panels 9 may be mounted to the furring strip, with at least one panel 9 in each u-shaped channel 8. In some embodiments, the length of each panel 9 may be less than the length of the furring strip 100. In such embodiments, a plurality of panels 9 may be placed adjacently along the length of the u-shaped channel 8.

In certain implementations, an opposite end of a wall cladding panel 9 may be secured to a second furring strip to securely mount the wall cladding panel 9 to the building substrate 5. Where a wall cladding panel 9 has already been placed into a u-shaped channel of a first furring strip 100, a second furring strip may then be obtained and a u-shaped channel of the second furring strip may then be placed onto the opposite end of the wall cladding panel 9. The second furring strip can then be fixed to the building substrate 5 at a location parallel to and laterally spaced along the building substrate 5 from the first furring strip 100. The second furring strip can similarly be fixed by mechanical fasteners, a chemical fastener, or a combination of mechanical and chemical fasteners. Thus, the wall cladding panel 9 can be confined by the base members of the u-shaped channels 8 of the first furring strip 100 and the second furring strip, such that the wall cladding panel 9 is prevented from sliding laterally out of either u-shaped channel 8. These steps may be repeated laterally or horizontally for any number of wall cladding panels 9 and furring strips 100 so as to form an array of wall cladding panels 9 and furring strips 100 substantially covering a wall or portion thereof. In some embodiments, the outermost furring strips in the array may be furring strip 500 as shown in FIG. 5A or furring strip 600 as shown in FIG. 6A, such that the finished wall covering system does not include empty u-shaped channels 8.

Figure 9:
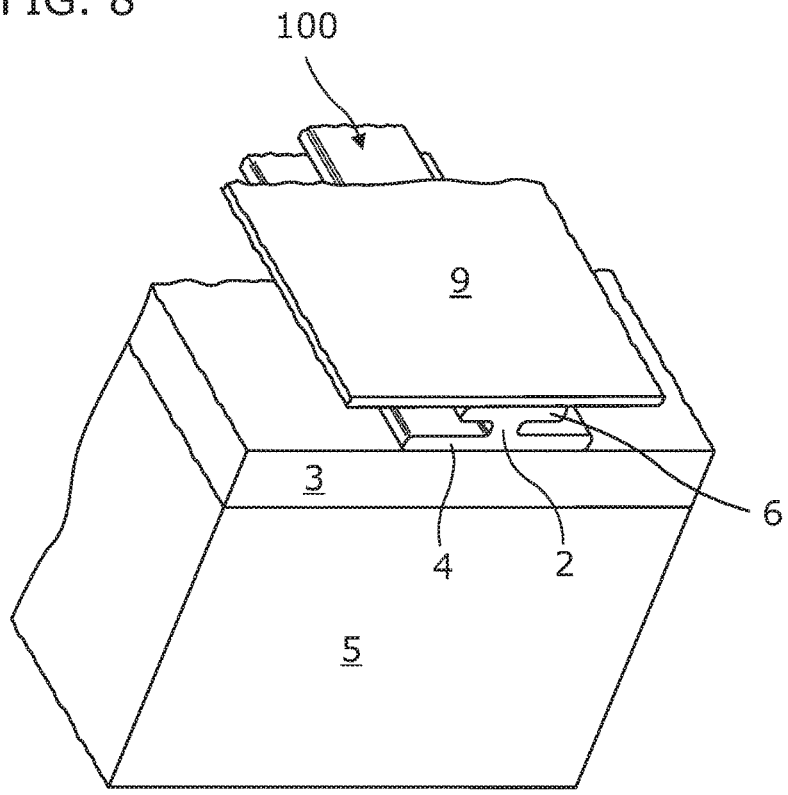
FIG. 9 is a perspective sectional view of a further embodiment of the furring strip of FIG. 1A installed on a building substrate.

FIG. 9 shows a further embodiment of the building system, wherein the fiber cement cladding article 9 is secured to the outermost face of the second member 6 of furring strip 100. Furring strip 100 acts as a spacer between the building substrate 5 and the fiber cement cladding article 9. The gap created by furring strip 100, between building substrate 5 and fiber cement cladding article 9 is approximately 0.47" (12 mm) or greater.

In other embodiments, the gap created by the furring strip 100 between building substrate 3 and the fiber cement cladding article 9 ranges between 0.25" (0.635 cm) and 1.25" (3.2 cm). Optionally, in further embodiments, the gap created by the furring strip 100 between building substrate 3 and the fiber cement cladding article 9 is greater than 1.25" (3.2 cm) as determined by building code regulations or by the end user.

Figure 10A:
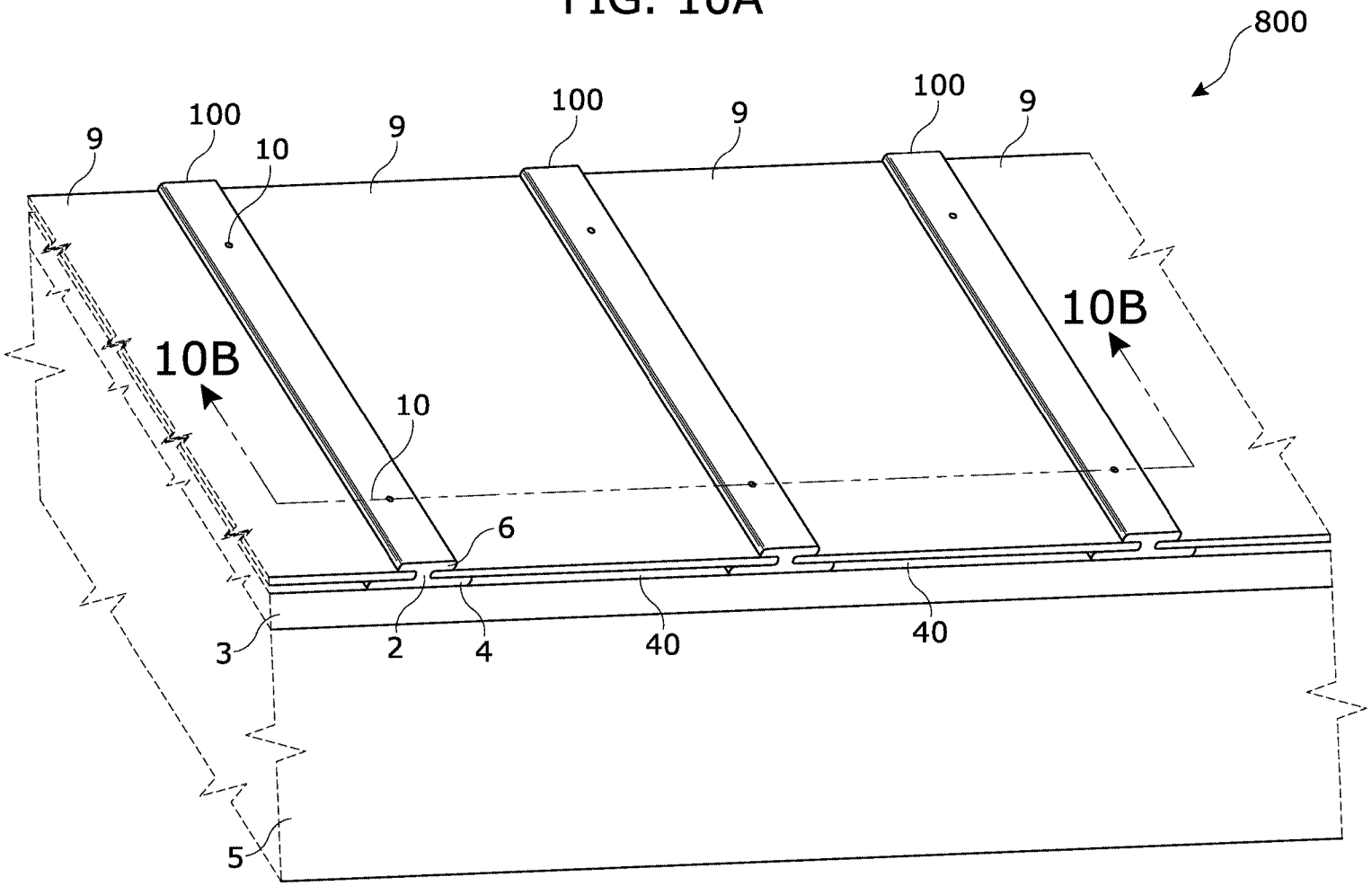
FIG. 10A is a perspective sectional view of an embodiment of multiple furring strips of FIG. 1A and cladding panels installed in an evenly spaced configuration on a building substrate.
Figure 10B:
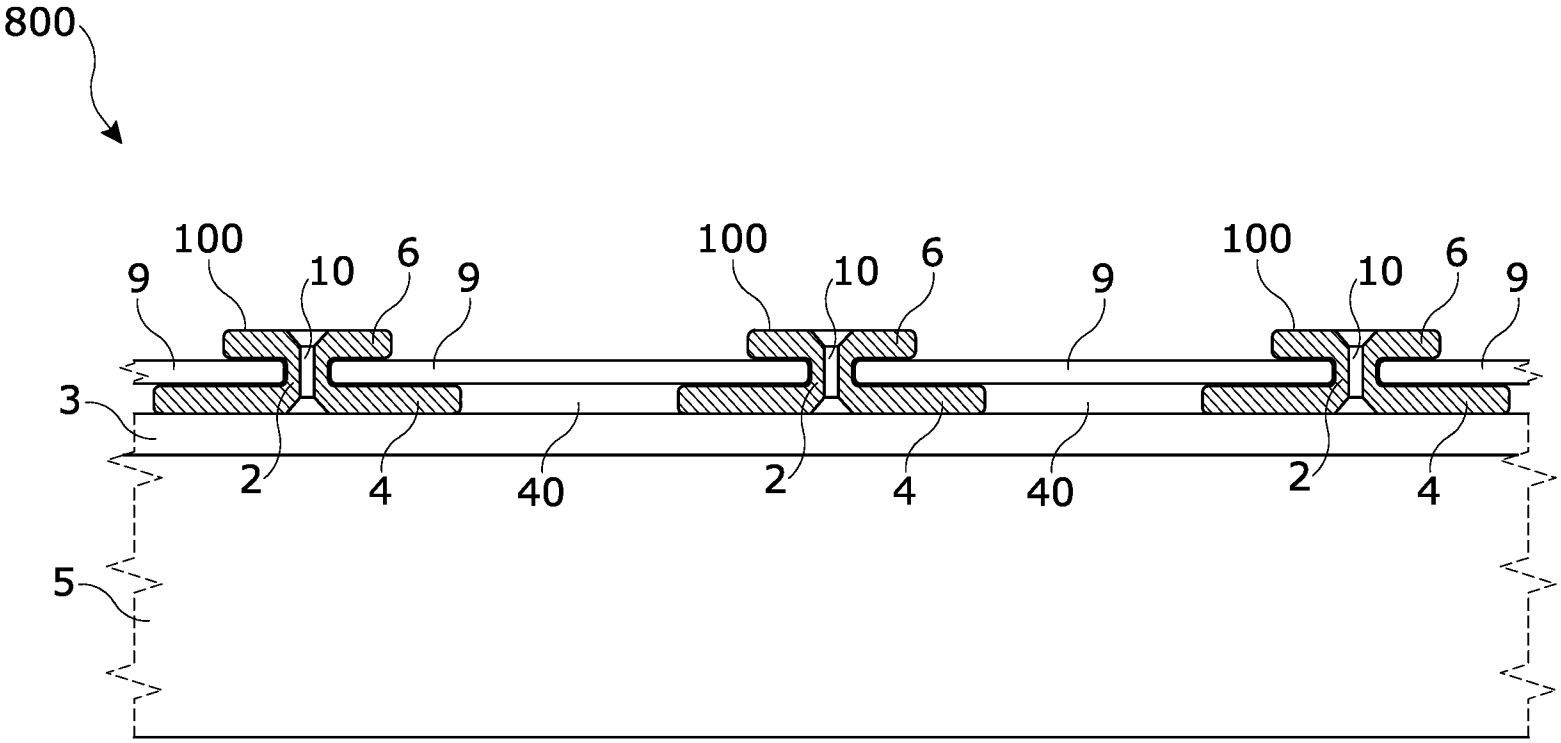
FIG. 10B is a cross-sectional view of the embodiment of furring strips and cladding panels depicted in FIG. 10A.

Referring now to FIGS. 10A and 10B, a building system 800 for attaching a plurality of cladding articles to a building substrate 5 is illustrated. The perspective view of FIG. 10A and the cross-sectional view of FIG. 10B show the building system 800 including an array of furring strips 100 retaining multiple cladding articles 9. Similar to the sectional view of FIG. 9, the furring strips 100 are secured to the building substrate 5 through an optional weather resistant barrier 3 by mechanical fasteners through openings 10. The furring strips 100 can be installed in a regularly spaced configuration such that a consistent lateral distance is provided between each pair of adjacent furring strips 100. The lateral distance may be determined based on the width of the cladding articles 9 to be retained by the furring strips 100. In the example system 800 depicted, the furring strips 100 are spaced such that the distance between adjacent webs 2 is equal to or slightly larger than the width of each cladding article 9. Thus, each cladding article 9 is retained in place by the webs 2, first members 4, and second members 6 of the two furring strips 100 surrounding the cladding article 9. The furring strips 100 can be made of a lightweight, dimensionally stable polymer.

Systems 800 of regularly spaced furring strips 100 and cladding articles 9 can thus be used to implement a modular rain screen system, with additional furring strips 100 and cladding articles 9 installed to cover a desired area of an exterior surface of a building. When installed as depicted in FIGS. 10A and 10B, an air gap 40 is created. The air gap 40 is generally bounded by the cladding panel 9, first members 4 of adjacent furring strips 100, and the weather barrier 3 covering the building substrate 5. The air gap 40 can act as a capillary break in the system 800, allowing for drainage and evaporation of liquids such as water that may enter the air gap 40.

Figure 11:
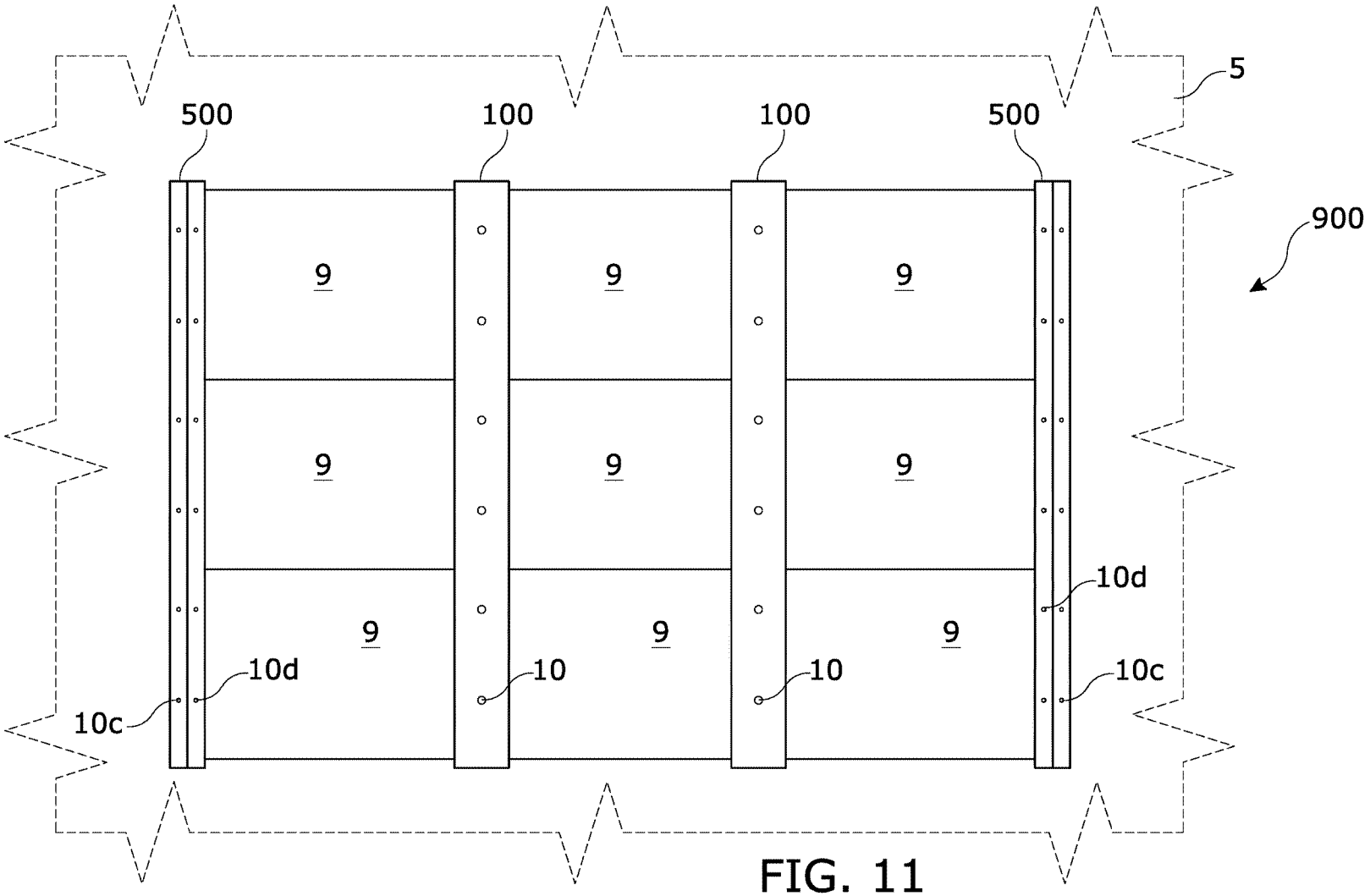
FIG. 11 is a front view of an embodiment of multiple furring strips of FIGS. 1A and 5A installed in an evenly spaced configuration on a building substrate.

FIG. 11 depicts another example building system 900 of furring strips 100, 500 and cladding articles 9 secured to a building substrate 5. In the building system 900, an array of cladding articles 9 are retained by furring strips 100, 500 in the same manner as described with reference to FIGS. 10A and 10B. Building system 900 depicts a system using a combination of furring strips 100 having two u-shaped channels as depicted in FIGS. 1A-1E, and furring strips 500 having a single u-shaped channel as depicted in FIGS. 5A-5D. In the building system 900, furring strips 500 are provided along the boundary of the area of the building surface 5 to be covered by cladding articles 9, as only one cladding article 9 is to be held in position by the furring strips 500. Thus, a second u-shaped channel is not necessary. Mechanical fasteners may be driven through openings 10*c* and 10*d* to secure furring strips 500 in place at the boundary of the area to be covered.

In various embodiments, furring strips 100, 500 may be longer than one or more dimensions of the cladding articles 9. Accordingly, each neighboring pair of furring strips 100, 500 may retain more than one cladding article 9 in a stacked orientation. In some aspects, the length of the furring strips 100, 500 may be a whole number multiple of the lengthwise dimension of each cladding article 9 such that the cladding articles 9 can extend the full length of the furring strips 100, 500 without requiring one or more of the cladding articles 9 to be cut or otherwise resized. For example, the furring strips 100, 500 depicted in FIG. 11 may be 12 feet long, while the cladding articles 9 may be 4 feet long such that three cladding articles 9 can have a length equal to the length of the pair of furring strips 100, 500 retaining the three cladding articles 9. In other embodiments, the furring strips 100, 500 and cladding articles 9 may have equal lengths such that each pair of furring strips 100, 500 is configured to retain a single cladding article 9.

It will be appreciated that the building systems 800, 900 depicted in FIGS. 10A-11 may be implemented with any of the furring strips described herein. For example, furring strips 100 having two u-shaped channels may instead be any of furring strips 200, 200*a*, 300, or 400, based on the thickness of cladding articles 9 and/or user preference. Similarly, furring strips 500 having one u-shaped channel may instead be furring strips 600, and/or may have u-shaped channels of any suitable width.

Accordingly, the building systems 800, 900 can provide enhanced wind load capacity by securing the outer edges of the cladding articles 9. Securing the cladding articles 9 at their outer edges, rather than nailing the cladding articles to a substrate at intermediate locations along the cladding articles 9, prevents air entry at the edges of the cladding articles 9. Moreover, the furring strips described herein can be made of polymeric composite materials that are resistant to fastener withdrawal, further preventing the loss of structural integrity of the building system 800, 900 under relatively high wind loads. Thus, the building systems 800, 900 can withstand a greater wind load than existing cladding systems.

Wind load capacity is determined by calculating the applied load capacity in accordance with ASTM E-330-02 (2010) 'The Standard Test Method for Structural Performance of Exterior Windows, Doors, Skylights and Curtain Walls by Uniform Static Air Pressure Difference'. The test measures the uniform static air pressure difference, inward and outward for which the building system and/or rainscreen system are designed to withstand under load conditions. The test monitors the displacement or change in dimensions of the system after the applied load has been removed. The rainscreen system of the present disclosure was tested using two different fastening configurations. In one test system, a fiber cement cladding panel 9 and furring strip 100 (as shown in FIGS. 1A to 1D) of the rainscreen system was secured in the testing apparatus using 4D stainless steel ring shank nails, whilst in the second test system, furring strip 100 of the rainscreen system was secured in the testing apparatus using 6D stainless steel smooth shank nails. In each rainscreen system the fiber cement panel 9 was secured to the outermost face of furring strip 9 as shown in FIG. 9. In the test, each system is set up as per the requirements set out in ASTM E-330-02 (2010). Positive and negative loads are applied separately to the system and each of the positive and negative loading is continuously increased systematically until the maximum load is reached for that system. The applied load data is collected and converted to wind load data using wind tables as set out in the appropriate building regulations for a particular jurisdiction. The standard wind tables used in accordance with the US building regulations set out the basic wind speeds (mph) experienced in various regions as defined by the topography of that region, for example a 'B' zone is a zone that is above 1200 ft (0.36 km). The standard wind tables also identify special wind regions within an area, such as, for example, hurricane vs non-hurricane areas. The results of the test systems are presented below in Table 1.

TABLE 1

Results of applied load tests of example building systems described herein.

| System | Test | Maximum Applied Load |
|---|---|---|
| ONE - 4D Ring Nails | ASTM E-330-02 (2010) | 96.2 psf (4.6 kPa) |
| TWO - 6D Smooth Nails | ASTM E-330-02 (2010) | 121.5 psf (5.82 kPa) |

To confirm the advantageous wind load properties of the furring strips and building systems and or rain screen system described herein, further wind load model testing was carried out to visualize the response of the fiber cement cladding article when secured to a building substrate under different conditions. Firstly, a series of control experiments were conducted wherein the fiber cement cladding article was nailed directly to a building substrate. In the test scenario control 1 was nailed directly to a building substrate at 16" (40.6 cm) intervals, whilst control 2 was nailed directly to a building substrate at 24" (61 cm) intervals.

Following the control experiments, a number of sample experiments were conducted wherein the fiber cement cladding article was attached to a building substrate using the furring strip 100 and using either mechanical or chemical fasteners. Sample 1 comprised a fiber cement cladding article secured to building substrate using furring strip 200 as depicted in FIGS. 2A-2D and nailed at 16" (40.6 cm) intervals along the length of the furring strip. Sample 2 comprised a fiber cement cladding article secured to building substrate using furring strip 200 and glued at 16" (40.6 cm) intervals along the length of the furring strip. Sample 3 comprised a fiber cement cladding article secured to building substrate using furring strip 200 and nailed at 24" (61 cm) intervals along the length of the furring strip. The fiber cement cladding article was the same for each of the control and sample tests, however in the samples 1 to 3, the fiber cement cladding article was inserted into the u-shaped channel as described with reference to FIGS. 1A-1E, and 10A-11.

Two deflection paths were measured during the testing process, the paths measured included critical areas between the intervals and along the nail or glue line. The performance of samples 1 to 3 indicate that use of furring strip 200 to secure the fiber cement cladding article improved the wind load resistance of the fiber cement cladding article by approximately 13 to 18% relative to the control experiment.

Furring strip 100 advantageously exhibits better resistance to nail withdrawal than wood at an equivalent thickness. Testing has shown that a furring strip of the present disclosure having a thickness of 0.1875" (0.48 cm) can achieve the equivalent resistance to nail withdrawal as a section of Oriented Strand Board (OSB) having a thickness of 0.4375" (1.11 cm).

Preferably the furring strip of certain embodiments of the present disclosure can be made from a durable polymer composite material which is waterproof, nailable and dimensionally stable, such as, for example a fiber reinforced polymer or a glass reinforced plastic. It is preferable for the polymer composite material to have limited thermal expansion and contraction when exposed to environmental conditions when in use in the field. It is also preferable for the durable polymer composite material to exhibit little to no carbonation shrinkage or moisture movement when exposed to environmental conditions when in use in the field. In one embodiment of the furring strip, thermal expansion corresponds to between 9 and 18 cm/cm/° C. (5 and $10\times10^{-6}$ in/in/F). Conveniently, the durable polymer composite material can also be resistant to nail withdrawal. In one embodiment, the durable polymer composite material is a thermoplastic or thermoset composite material. In a further embodiment, the durable polymer composite material has a thermal break value R 2.5 or greater. In one embodiment of the present disclosure, the durable polymer composite is formed using suitable techniques such as extrusion, pultrusion, moulding, or casting.

Optionally, in a further embodiment, the furring strip comprises a fiber cement furring strip. Accordingly, a fiber cement furring strip is made in accordance with suitable techniques known to the person skilled in the art.

In a further embodiment of the furring strip it is possible to apply one or more coatings to the furring strip in order to provide functional and/or aesthetic surface coverings. The one or more coatings serve to protect the furring strip and/or allow the end user to match the coating of the fiber cement cladding article with that of the furring strip.

In use, the furring strip 100 can be installed on a building substrate 5 at regularly spaced intervals. In one embodiment the furring strip 100 is attached to the building substrate 5 in a vertical orientation relative to ground level. In a further embodiment the furring strip 100 is attached to the building substrate 5 in a horizontal orientation relative to ground level. Conveniently, furring strips 500, 600 of FIGS. 5A-5D and 6A-6C, respectively, can be particularly suitable for attachment to a building substrate in a horizontal orientation relative to ground level. The configuration of furring strip 500, 600 enables an end user to attach a fiber cement cladding article on either side of web 22, 32 whilst maintaining an open channel on one side of the web to allow fluid to drain away as necessary.

In a further embodiment, an insulating layer is positioned between the furring strip and the building substrate or moisture barrier layer. In one embodiment the insulating layer comprises a foam layer. Conveniently, in such an embodiment the furring strip is attached to the substrate through the foam layer.

In a further embodiment, the furring strip of the present disclosure can also be used to facilitate retro fitting buildings which have concrete or brick substrate The foregoing description of the preferred embodiments of the present disclosure has shown, described and pointed out the fundamental novel features of the inventions. The various devices, methods, procedures, and techniques described above provide a number of ways to carry out the described embodiments and arrangements. Of course, it is to be understood that not necessarily all features, objectives or advantages described are required and/or achieved in accordance with any particular embodiment described herein. Also, although the invention has been disclosed in the context of certain embodiments, arrangements and examples, it will be understood by those skilled in the art that the invention extends beyond the specifically disclosed embodiments to other alternative embodiments, combinations, sub-combinations and/or uses and obvious modifications and equivalents thereof. Accordingly, the invention is not intended to be limited by the specific disclosures of the embodiments herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used in conjunction with fastening building panel support profiles to substrates, and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A rain screen system for protecting an exterior building substrate from moisture, the rain screen system comprising:

a furring strip made of a polymeric material, said furring strip comprising:

a first member and a second member, wherein the first member is parallel to and spaced apart from the second member;

a web disposed between the first member and the second member, said web connecting the first and second members in a manner so as to form a channel defined by a channel width, the first member and the second member being spaced apart by the channel width; and a plurality of openings configured to receive a mechanical connector, each opening extending through the first member, the second member, and the web of the furring strip; and at least one wall cladding panel comprising fiber cement, said wall cladding panel having a first main face and a second main face, the second main face being separated from the first main face by a panel thickness approximately equal to the channel width;

wherein the building system is mounted to the exterior building substrate in a manner such that the first member of the furring strip is positioned adjacent to the exterior building substrate and the second member extends outwardly from the exterior building substrate, wherein a portion of the wall cladding panel is disposed within the channel between the first and second members, and wherein the channel retains the wall cladding panel in a position parallel to and spaced from the building substrate such that the building system is configured to withstand an applied load of approximately 4.5 kPA (96 psf).

2. The rain screen system of claim 1 further comprising a weather resistant barrier disposed between the building substrate and the first member.

3. The rain screen system of claim 1, wherein the web, the first member, and the second member of the furring strip form a first channel and a second channel, wherein the second channel is separated from the first channel by the web.

4. The rain screen system of claim 3, wherein the rain screen system comprises the at least one wall cladding panel as a first wall cladding panel and at least one second wall cladding panel, a portion of the first wall cladding panel being disposed within the first channel and a portion of the second wall cladding panel being disposed within the second channel of the furring strip.

5. The rain screen system of claim 1, wherein each of the height of the first member and the height of the second member is between approximately 0.9 inches and approximately 3 inches.

6. The rain screen system of claim 1, wherein the channel width is between approximately 0.25 inches and approximately 0.75 inches.

7. The rain screen system of claim 1, wherein the width of furring strip between opposing exterior surfaces of the first and second member remote the first channel ranges between approximately 0.75" (1.9 cm) and 1.25" (3.2 cm).

8. A furring strip for mounting a wall cladding panel to a building substrate, the furring strip comprising:

a first member generally defined by a length along a first major axis and a height along a first minor axis perpendicular to the first major axis, a second member generally defined by a length along a second major axis parallel to the first major axis and a height along a second minor axis parallel to the first minor axis;

a web generally defined by a length along a third major axis parallel to the first major axis and the second major axis, the web being disposed between and spacedly coupling the first member and the second member; and a plurality of openings configured to receive a mechanical connector, each opening extending through the first member, the second member, and the web of the furring strip, wherein the furring strip comprises a polymeric material, and wherein the first member, the second member, and the web form at least one channel extending along the length of the web and configured to receive and retain a wall cladding panel.

9. The furring strip of claim 8, wherein the height of the first member is equal to the height of the second member.

10. The furring strip of claim 8, wherein the height of the first member is greater than the height of the second member.

11. The furring strip of claim 8, wherein the furring strip is configured to be installable in either of a first user selectable configuration in which the first member is adjacent to the building substrate or a second user selectable configuration in which the second member is adjacent to the building substrate.

12. The furring strip of claim 8, wherein each of the first member and the second member comprises an interior face adjacent to the channel, an exterior face, and two ends intermediate the interior face and the exterior face.

13. The furring strip of claim 12, wherein the ends of at least the first member are tapered such that the height along the interior face of the first member is greater than the height along the exterior face of the first member.

14. The furring strip of claim 8, wherein the lengths of the first member, the second member, and the web are substantially equal and greater than or equal to 8 feet (2.44 m).

15. The furring strip of claim 8, wherein each of the height of the first member and the height of the second member is between approximately 0.9 inches (2.3 cm) and approximately 3 inches (7.6 cm).

16. The furring strip of claim 8, wherein the channel has a width defined by the distance between the first member and the second member, the width of the channel being between approximately 0.25 inches (0.6 cm) and approximately 0.75 inches (1.9 cm).

17. The furring strip of claim 8, wherein the furring strip comprises an extruded polymeric thermoplastic composite material having a thermal expansion value between 9 and 18 cm/cm/° C. (5 and $10\times10^{-6}$ in/in/F).

18. A method of mounting a rain screen system to a building substrate, comprising the steps of:

a) obtaining a wall cladding panel, wherein the wall cladding panel comprising a planar sheet having a first main face and a second main face separated from the first main face by a panel thickness;

b) obtaining a first furring strip comprising a first member, a second member parallel to the first member, a web disposed between the first member and the second member to form a channel having a channel width approximately equal to the panel thickness, and a plurality of openings configured to receive a mechanical connector, each opening extending through the first member, the second member, and the web of the furring strip;

c) fixing the first furring strip to the building substrate; and d) placing a portion of the wall cladding panel into the channel to retain the wall cladding panel in a position parallel to and spaced from the building substrate.

19. The method of claim 18, comprising the further steps of (c1) after step (c), wherein step (c1) comprises the step of fixing a second furring strip to the building substrate such that the first furring strip and the second furring strip are arranged in a parallel, spaced apart configuration on the building substrate.

20. The method of claim 18, wherein attaching the first furring strip to the building substrate comprises placing the first member or the second member against the building substrate, and inserting a mechanical fastener through the second member, the web, and the first member to secure the first furring strip to the building substrate.

* * * * *